US005893362A

United States Patent [19]

Evans

[11] Patent Number: 5,893,362

[45] Date of Patent: Apr. 13, 1999

[54] SNORKELLING DEVICE

[76] Inventor: Alan James Evans, 10 Franklin Ct., Gosnells, Australia, 6110

[21] Appl. No.: 08/557,093

[22] PCT Filed: Jun. 8, 1994

[86] PCT No.: PCT/AU94/00311

§ 371 Date: Mar. 11, 1996

§ 102(e) Date: Mar. 11, 1996

[87] PCT Pub. No.: WO94/29167

PCT Pub. Date: Dec. 22, 1994

[30] Foreign Application Priority Data

Jun. 8, 1993 [AU] Australia ..... PL 9225

[51] Int. Cl.[6] ..... B63C 11/16

[52] U.S. Cl. ..... 128/201.11; 128/200.29; 128/201.27

[58] Field of Search ..... 128/201.11, 200.29, 128/201.27, 202.14, 200.24, 911, 207.14

[56] References Cited

U.S. PATENT DOCUMENTS

| | | | |
|---|---|---|---|
| 1,197,115 | 9/1916 | Fell et al. | 128/201.11 |
| 1,946,126 | 2/1934 | Black . | |
| 3,721,235 | 3/1973 | Ball et al. | 128/200.29 |
| 5,027,805 | 7/1991 | Kung | 128/201.11 |
| 5,117,817 | 6/1992 | Lin | 128/201.11 |
| 5,193,530 | 3/1993 | Gamow et al. | 128/201.27 |
| 5,351,681 | 10/1994 | Hudson | 128/201.11 |

FOREIGN PATENT DOCUMENTS

| | | |
|---|---|---|
| 780018 | 4/1935 | France . |
| 2 187 103 | 9/1987 | United Kingdom . |

*Primary Examiner*—Vincent Millin
*Assistant Examiner*—William J. Deane, Jr.
*Attorney, Agent, or Firm*—Larson & Taylor

[57] ABSTRACT

A snorkelling device for supplying air to a person by unassisted lung function to a depth of approximately one meter. The device may be used upon or below the surface of the water. It comprises an air intake incorporating a float valve (14) for closing the air intake when it becomes submerged. A mouthpiece (16) is connected to the air intake by a flexible hose (18). The mouthpiece (16) has an inlet valve (20) to prevent the return of expelled gases up the flexible hose (18) during exhalation, and an outlet valve (22) to allow expelled gases to escape to ambient water during exhalation. A float (24) is provided adjacent the air intake to normally hold the air intake above the surface of the water. A weight (28) is provided in connection with the flexible hose (18) and is sufficiently heavy to exert a downward force on the flexible hose (18) so as to cause the float (24) and air intake to maintain a generally upright position. The device allows a person to breathe air at atmospheric pressure whilst submerged at depths of up to approximately one meter, and to descend without breathing to free diving depths.

9 Claims, 7 Drawing Sheets

(a)

(b)

(b)

(a)

SNORKELLING DEVICE

FIELD OF THE INVENTION

This invention relates to an improved snorkelling device for supplying air directly to a person by unassisted lung function on or below the water surface to an approximate depth of one meter and to allow the person to descend without benefit of respiration to free diving depths.

BACKGROUND TO THE INVENTION

A prior art breathing apparatus is described by J. L. Belcher in U.S. Pat. No. 1,901,219 which issued on Mar. 14, 1933. With the apparatus of Belcher a person is able to swim upon the surface of the water and descend to shallow depths while maintaining a cycle of unassisted respiration. The apparatus of Belcher consists of a float arranged to normally retain the open ends of an air intake tube and exhaled gases tube projecting above the surface of the water. The other end of the air intake tube is bifurcated with respective branches connecting into a pair of inlet ports provided in the sides of a breathing mask that covers the divers nose and mouth. Each inlet port is fitted with a one way flap-valve. The exhaled gases tube is connected to an exhaust port provided in the base of the mask and is fitted with a similar one-way flap-valve. The valve configuration and tubes of the apparatus of Belcher provide the wearer with a source of fresh air by the natural breathing process, while also prohibiting the rebreathing of exhaled gases.

One of the disadvantages of the apparatus of Belcher is that if the float supporting the air intake and exhaust tube is accidentally or deliberately pulled under the water surface, the entire apparatus will flood making it unusable until the water has been purged from the tubes. A further disadvantage is that the wearer's limit of descent is controlled by the overall length of the apparatus. Another disadvantage is the provision of the air intake tube, exhaust tube and non-return valves in connection with a breathing mask covering the wearer's nose and mouth. This prevents the person from wearing a conventional face mask. A still further disadvantage is the relative complexity of construction of the apparatus of Belcher, in particular the multiplicity of tubes, which makes the apparatus more expensive to make and clumsy to use.

The present invention was developed with a view to providing an improved snorkelling device for supplying air to a person by unassisted lung function to a depth of approximately one meter.

SUMMARY OF THE INVENTION

According to one aspect of the present invention there is provided a snorkelling device for supplying air to a person by unassisted lung function to a depth of approximately one meter, the device comprising:

an air intake incorporating a float valve for closing the air intake when it becomes submerged;

a mouth piece connected to the air intake by a flexible hose, the mouth piece having an inlet valve adapted to prevent the return of expelled gases up the flexible hose during exhalation and an outlet valve adapted to allow expelled gases to escape to ambient water during exhalation;

a float provided adjacent the air intake and adapted to normally hold the air intake above the surface of the water; and, a weight provided in connection with the flexible hose at a prescribed distance from the float, the weight being sufficiently heavy to exert a downward force on the flexible hose so as to cause the float and the air intake to maintain a generally upright position whereby, in use, the person can breath air at atmospheric pressure whilst submerged to depths of up to approximately one meter and can descend without breathing to free diving depths by drawing the float with the air intake down below the surface of the water.

Advantageously the device also includes a vacuum control means for eliminating any partial vacuum that may be formed within the flexible hose in the event the person inhales through the mouthpiece whilst the air intake is fully submerged.

In a preferred embodiment the inlet valve is in the form of a flexible diaphragm mounted on a support grid provided in connection with a valve seat, and wherein said vacuum control means operates by causing the diaphragm to be at least partially lifted from the valve seat thereby providing a path for air to enter the flexible hose.

Preferably said vacuum control means comprises a bypass passage provided to bypass said inlet valve and allow a flow of air from the mouthpiece to the flexible hose, said bypass passage having a tap for manually opening and closing the bypass passage.

According to another aspect of the present invention there is provided a conversion kit for converting a conventional snorkel of the type having an air intake incorporating a float valve for closing the air intake when it becomes submerged, the air intake being connected to a mouthpiece by a rigid tube, and the mouthpiece having an outlet valve adapted to allow expelled gases to escape to ambient water during exhalation, to a snorkelling device for supplying air to a person by unassisted lung function to a depth of approximately one meter, the kit comprising:

a flexible hose adapted to replace the rigid tube of the conventional snorkel, the flexible hose having an inlet valve provided proximate the point of connection with the mouthpiece to prevent the return of expelled gases up the flexible hose during exhalation;

a float to be connected adjacent the air intake and adapted to normally hold the air intake above the surface of the water; and, a weight adapted to be connected to the flexible hose at a prescribed distance from the float, the weight being sufficiently heavy to exert a downward force on the flexible hose so as to cause the float and the air intake to maintain a generally upright position whereby, in use, the person can use the converted snorkel to breathe air at atmospheric pressure whilst submerged to depths of up to approximately one meter and can descend without breathing to free diving depths by pulling the float with the air intake down below the surface of the water.

BRIEF DESCRIPTION OF THE DRAWINGS

In order to facilitate a better understanding of the nature of the invention preferred embodiments of the snorkelling device will now be described in detail, by way of example only, with reference to the accompanying drawings in which.

DETAILED DESCRIPTION OF PREFERRED EMBODIMENTS

Figure 1:
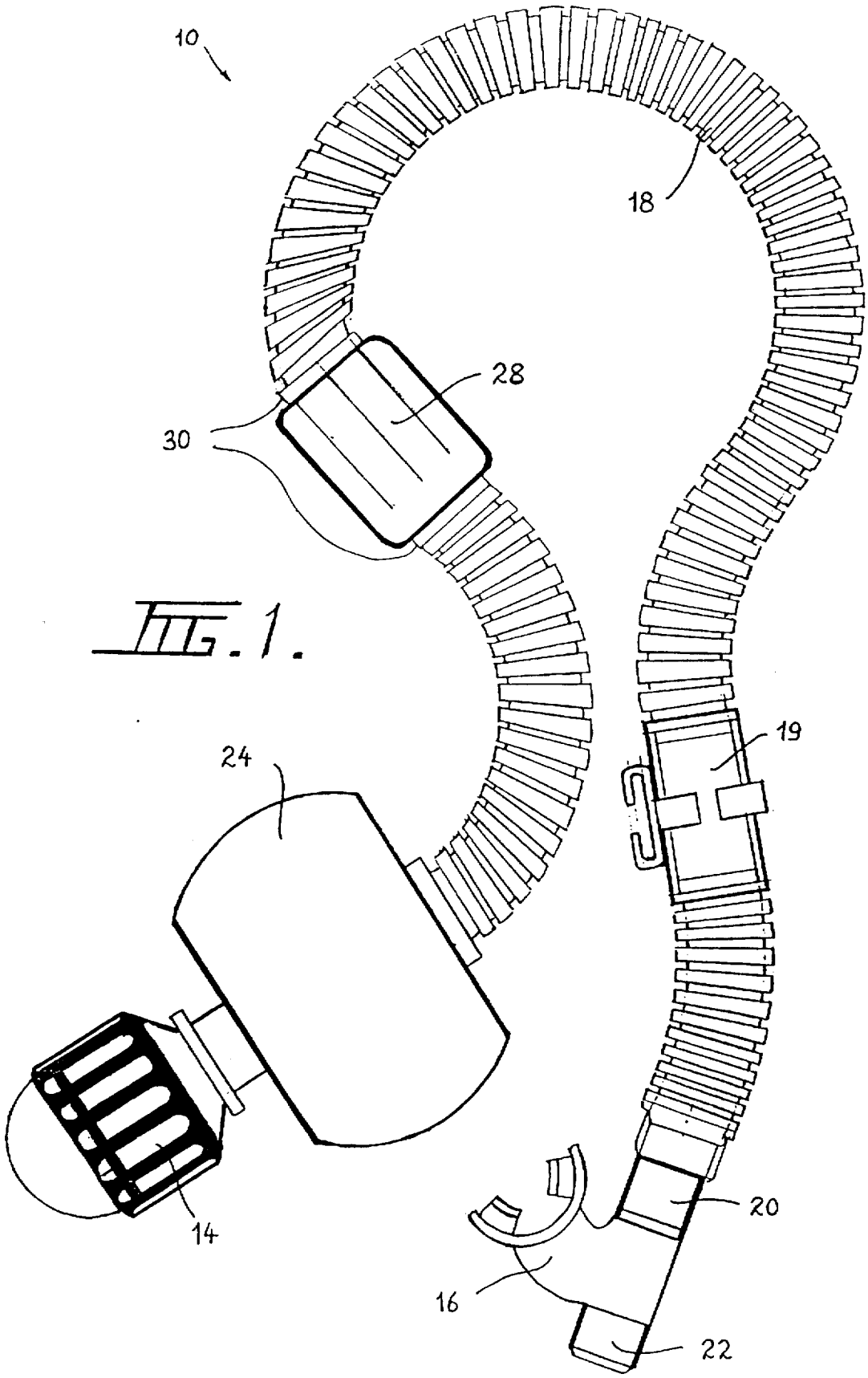
FIG. 1 illustrates a preferred embodiment of the snorkelling device according to the invention.

The preferred embodiment of the snorkelling device 10 illustrated in FIG. 1 comprises an air intake 12 incorporating a float valve 14 for closing the air intake when it becomes submerged below the surface of the water. A mouthpiece 16 is connected to the air intake 12 by a flexible hose 18. The flexible hose 18 is typically approximately one meter long, and limits the depth to which a person can use the device to breathe air at atmospheric pressure by unassisted lung function. At depths greater than approximately one meter a person cannot breathe with unassisted lung function as the water pressure becomes too great. A mask attachment 19 is provided on the flexible hose 18 to allow the hose to be connected to the strap of the diver's mask.

The mouthpiece 16 has an inlet valve 20 adapted to prevent the return of expelled gases up the flexible hose 18 during exhalation. It is important that exhaled air is prevented from returning back into the flexible hose 18, so as to prevent the accumulation of carbon dioxide within the flexible tube 18. The mouthpiece 16 also has an outlet valve 22 adapted to allow expelled gases to escape to ambient water during exhalation.

Figure 2:
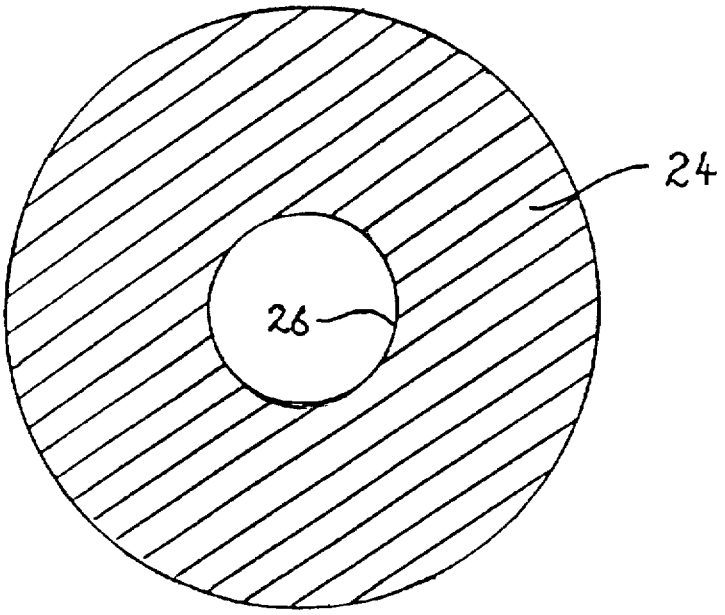
FIGS. 2(*a*) and (*b*) are section views through the float employed in the embodiment of FIG. 1.
Figure 2:
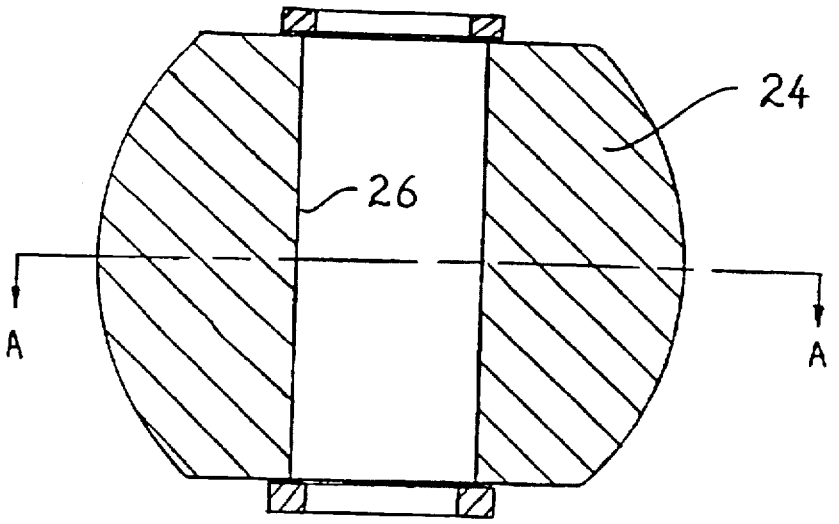

The snorkelling device 10 further comprises a float 24 provided adjacent the air intake 12 and adapted to normally hold the air intake above the surface of the water. As shown in FIG. 2, float 24 is of substantially cylindrical shape having a centre bore 26 in which the air intake 12 can be mounted. FIG. 2(*a*) is a section view through the line A—A in FIG. 2(*b*). Float 24 is preferably manufactured from polystyrene foam, although any suitably buoyant material can be employed.

The snorkelling device preferably further comprises a metal weight 28 provided in connection with the flexible hose at a prescribed distance below the float 24. In use, the weight 28 is of sufficient mass to exert a downward force on the flexible hose 18 so as to cause the float 24 and the air intake 12 to maintain a generally upright position in the water. Weight 28 is typically in the form of a metal ring or small cylinder of suitably heavy metal, for example, lead, and with an inside bore slightly larger than the outer diameter of flexible hose 18. Metal weight 28 is slidably received on flexible hose 18 and is retained at the required distance below float 24 by two plastic retaining rings 30 which clamp onto the exterior surface of the flexible hose 18 by a friction fit or by other suitable securing means.

Figure 3:
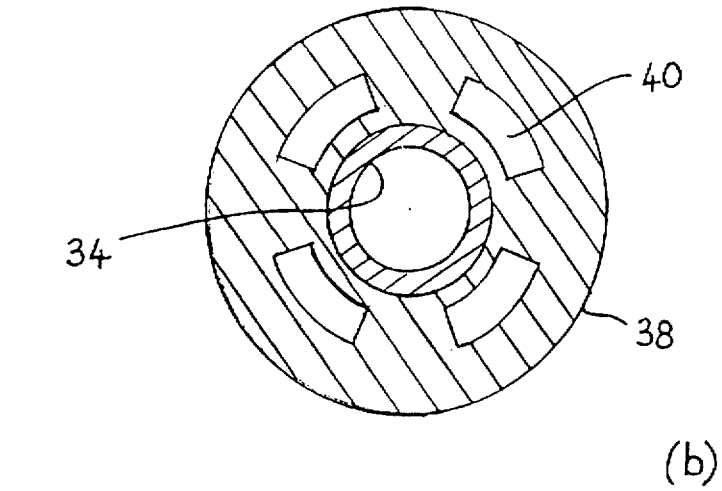
FIGS. 3(*a*) and (*b*) are section views through the air intake incorporating a float valve employed in the embodiment of FIG. 1.
Figure 3:
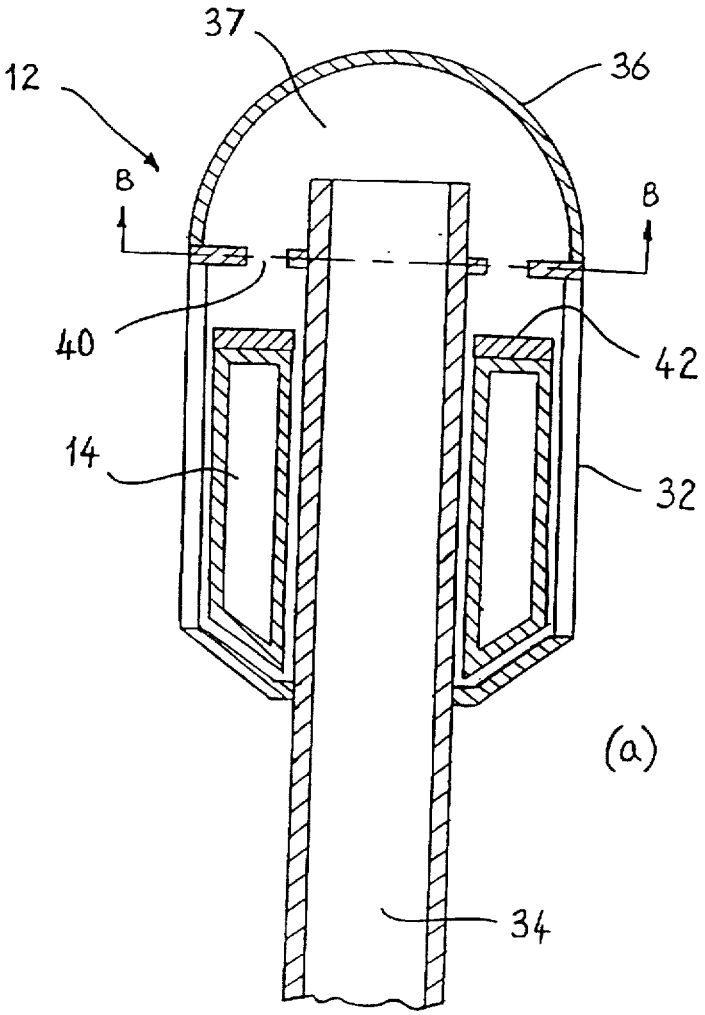

Air intake 12, which incorporates a float valve 14, may be of conventional construction, for example, of the type having a ping-pong ball trapped within a retaining cage. FIG. 3 illustrates a preferred form of air intake 12 incorporating a float valve 14. As can be seen most clearly in FIG. 3(*a*), this embodiment of the air intake 12 comprises a housing 32 having a central bore within which is mounted the open end of a hollow tube 34. Housing 32 has a substantially cylindrical side wall with elongate slots formed therein to allow the free passage of air into and out of the housing 32. An upper cover 36 of the housing is in the form of a hollow hemispherical dome designed to cover the open end of tube 34 to inhibit the entry of water into the mouth of tube 34. The upper interior portion of housing 32, enclosed by cover 36, is separated from the lower portion of housing 32 by a plate 38 provided with apertures 40 therein which acts as a valve seat for float valve 14. The configuration of valve seat 38 may be seen more clearly in FIG. 3(*b*) which is a sectional view through the housing 32 along the line B—B in FIG. 3(*a*).

Float valve 14 is in the form of a hollow cylindrical float which is slidably received about the outer circumference of tube 34. A sealing washer 42 is provided on the upper surface of float 14 and is designed to seal apertures 40 in the closed position to prevent the ingress of water into the upper portion 37 of air intake 12. Sealing ring 42 may be made from rubber or other suitably soft and resilient material. Float valve 14 is shown in its open position to allow the free flow of air through apertures 40 into the upper portion 37 of the housing, and into the mouth of hollow tube 34. Hollow tube 34 is received within the bore of float 24 and is coupled to the upper end of flexible hose 18 with a water tight connection.

The illustrated embodiments of the snorkelling device 10 may be used in the following three ways:

Stage 1—surface function

Stage 2—underwater function to an approximate depth of one meter

Stage 3—underwater function beyond a depth of approximately one meter.

Stage 1:

The flexible hose 18 is connected to the diver's mask (not illustrated) with mask attachment 19, and the mask is placed upon the diver's head. (Note: the snorkelling device can also be used without a mask.) The diver places the float 24 upon the surface of the water with air intake 12 in an upright position, and allows these components to float free although the apparatus as a unit remains in the possession and control of the diver. Metal weight 28 exerts a downward force upon the flexible hose 18 and this downward force keeps the length of flexible hose 18 between weight 28 and float 24 in a generally vertical orientation. As the downward force of weight 24 is also brought to bear via flexible hose 18 upon the float 24, the float 24 is obliged to assume a generally upright position thus ensuring that the air intake 12 and float valve 14 are also maintained in a generally upright position. Metal weight 28 is of sufficient mass to maintain the generally upright position of float 24, air intake 12 and float valve 14, but is not sufficiently heavy to fully submerge float 24. Typically only a small portion of the base of float 24 is submerged due to the downward force of weight 28.

When the diver has placed the mouthpiece 16 in his mouth and swims upon the surface, air may be drawn into the diver's lungs through flexible hose 18 and via air intake 12 by normal lung function. Following inhalation, the exhaled gases are forced into the mouthpiece 16, simultaneously closing the inlet valve 20 and opening the outlet valve 22, venting the gases into the ambient water. When the diver next inhales, outlet valve 22 closes by the simultaneous action of inhaled negative pressure and positive water pressure, and inlet valve 20 opens to allow fresh air to be drawn into the lungs via flexible hose 18. Respiration at atmospheric pressure can therefore be maintained with normal lung function.

Stage 2:

As the diver descends below the surface of the water to a depth of approximately one meter, the breathing and respiratory functions are maintained as described in Stage 1, but as the water depth increases the water pressure on the diver's chest progressively restricts the diver's breathing. At a depth of approximately one meter breathing and respiration by normal lung function becomes impossible.

Stage 3:

If the diver wishes to descend deeper than the cut-off breathing depth, he may inhale fresh air before diving and retain the inhaled air in his lungs while descending. Air may also be exhaled via outlet valve 22 in the same manner described above. As the diver descends by conventional means the entire apparatus is progressively drawn under the water. As the float 24 and air intake 12 become submerged, float valve 14 moves upwards to a closed position in which it seals the apertures 40 [see FIG. 3(*a*)], so as to prevent water from entering the flexible hose 18 via the air intake 12. Float 24 continues to maintain the air intake 12 and float valve 14 in a generally upright position, so that float valve 14 remains closed and no water is permitted to enter the flexible hose 18 for the duration of the dive.

When the diver returns to the surface of the water, float 24 will normally break the surface ahead of the diver. The diver becomes aware that the float 24 has broken the surface by the reduced flotation pressure of the float 24 relayed by the length of flexible hose 18 to the diver's head. When float 24 has broken the surface, air intake 12 and float valve 14 are held in a generally upright position above the surface of the water. As there is no longer flotation pressure exerted on the float valve 14, it should normally fall away from the apertures 14 of air intake 12, thereby allowing a free flow of air to the diver. However, if during the descent or ascent of the dive the diver has deliberately or accidentally inhaled through mouthpiece 16 whilst the apparatus is fully submerged, some air trapped within flexible hose 18 may be drawn through the inlet valve 20, thereby creating a partial vacuum within the flexible hose 18. In these circumstances, the float valve 14 will be prevented from falling away from the apertures 40 in air intake 12 when it regains the surface, due to the positive air pressure being exerted on the float valve 14. Therefore, the snorkelling device typically further comprises a vacuum control means for eliminating any partial vacuum that may be formed within the flexible hose 18.

Figure 4:
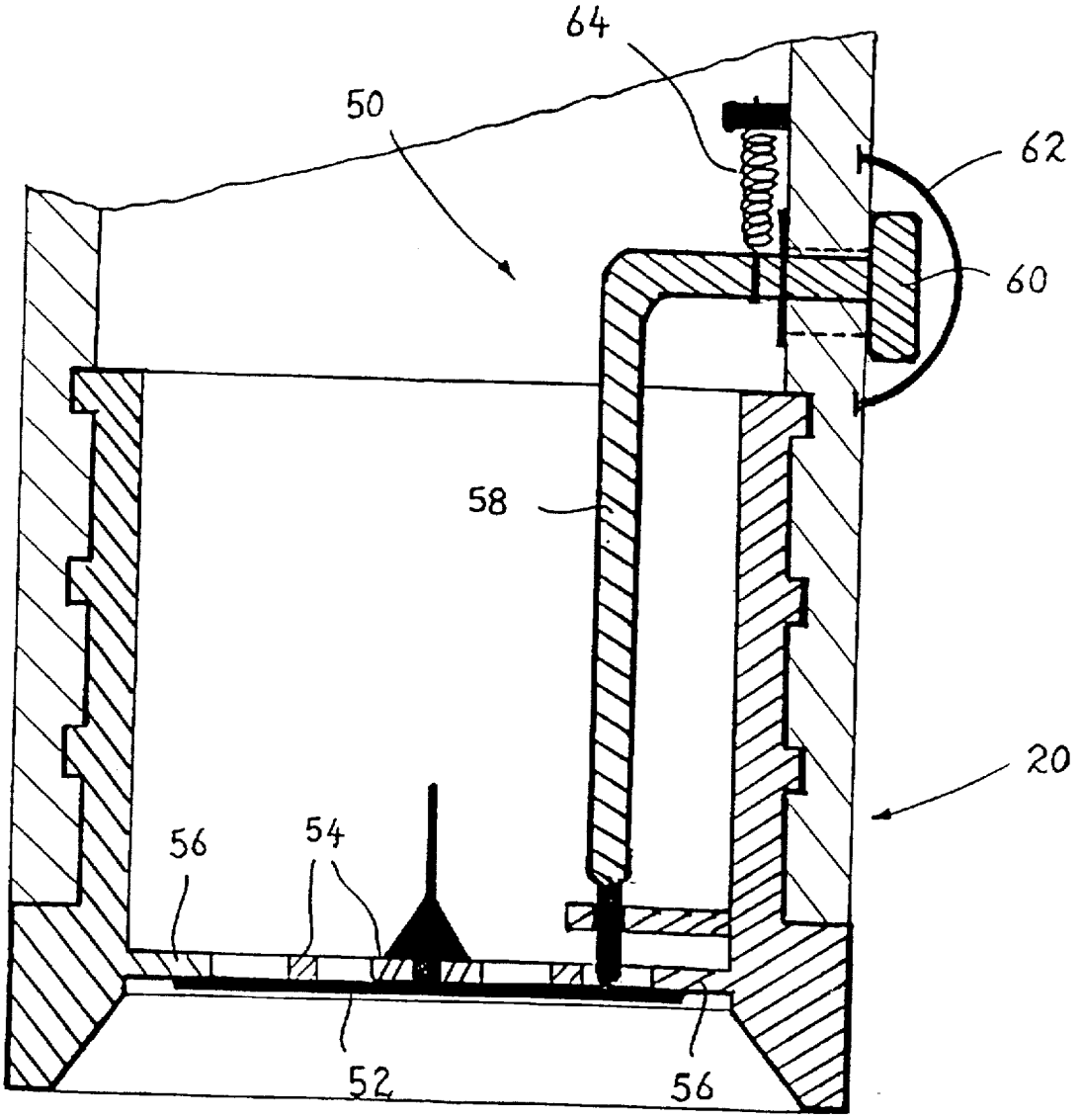
FIG. 4 is a section view through an inlet valve employed in the snorkelling device of FIG. 1, showing one form of vacuum control means.

FIG. 4 illustrates a first form of vacuum control means 50 provided in connection with the inlet valve 20. In this embodiment, inlet valve 20 is in the form of a flexible diaphragm 52 mounted on a support grid 54 provided in connection with a valve seat 56 of the inlet valve. A configuration of the support grid 54 and valve seat 56 may be seen more clearly in FIG. 7(*a*). This form of inlet valve is well known in the prior art and will not be further described here. Vacuum control means 50 comprises a finger-operated slidable member 58 which is actuated by the diver applying a downward force upon a vacuum control knob 60, and is adapted to lift an edge of the diaphragm 52 from the valve seat when moved from a first position to a second position by the diver. Vacuum control knob 60 is covered by a flexible water proof cap 62 to prevent the ingress of water into the housing of inlet valve 20. The free end of slidable member 58 sits just above the diaphragm 52 in its first position, and moves two or three millimeters to its second position to force the diaphragm away from the valve seat 56 and thereby break the partial vacuum within flexible hose 18. A return spring 64 automatically returns the slidable member 58 to its first position.

If the diver discovers that he is unable to inhale air through the snorkelling device upon returning to the surface, he simply operates vacuum control knob 60 to break the partial vacuum and release the float valve 14 from the apertures 40 in air intake 12. A different form of vacuum control means 70 is illustrated in FIG. 5.

Figure 5:
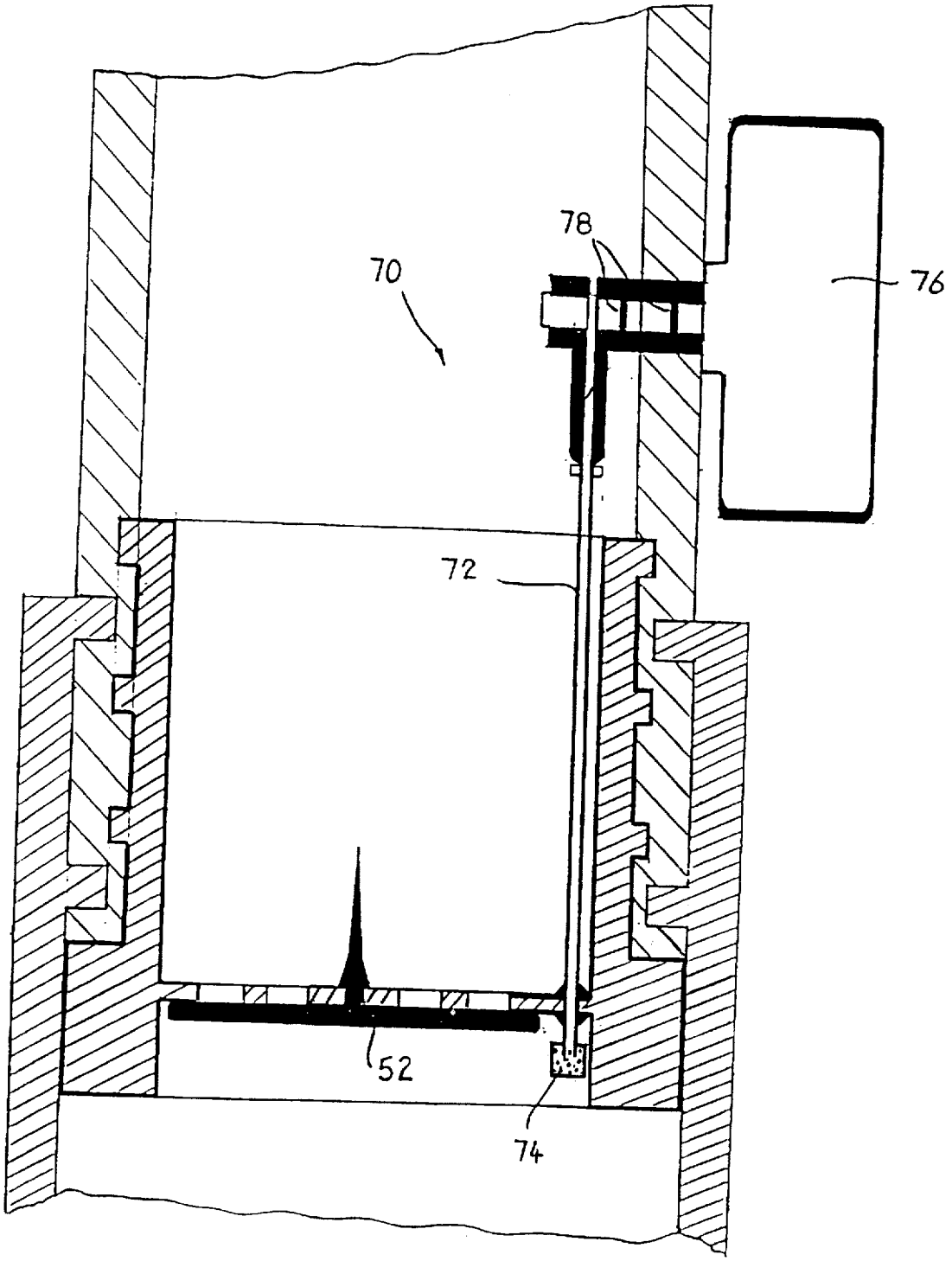
FIG. 5 is a section view through an inlet valve employed in the snorkelling device of FIG. 1, showing another preferred form of vacuum control means.

In FIG. 5, vacuum control means 70 comprises a bypass passage in the form of a small rigid tube 72 which passes through the inlet valve housing adjacent the diaphragm 52. A small filter cap 74 is provided on the lower end of bypass tube 72 to prevent the tube becoming blocked with sand or other particles that may enter the mouthpiece 16 in use. The other end of bypass tube 72 is provided with a tap 76 for manually opening and closing the bypass passage. Tap 76 is rotatably mounted in an aperture provided in the wall of a rigid tube connecting the inlet valve to the flexible hose 18. O-rings 78 seal the tap 76 in the wall of the rigid connecting tube to prevent the ingress of water. Vacuum control tap 76 may be operated in a similar manner to the vacuum control knob 60 of the previous embodiment to break any partial vacuum that may form in the flexible hose 18, and thereby release the float valve from its closed position.

Figure 6:
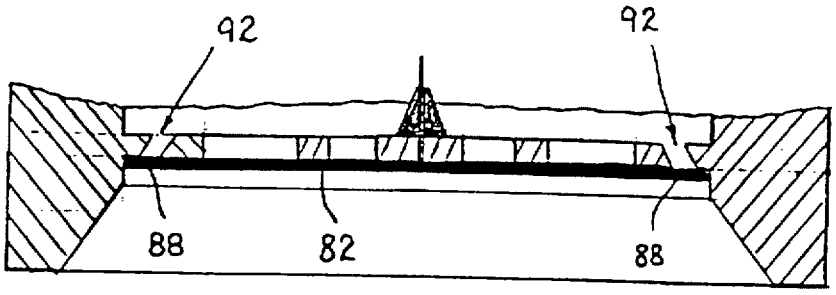
FIGS. 6(*a*) and (*b*) are section views though an inlet valve employed in the snorkelling device of FIG. 1 showing a more preferred form of vacuum control means; and, FIGS. 7(*a*) and (*b*) are plan views of parts of the vacuum control means illustrated in FIG. 6.
Figure 6:
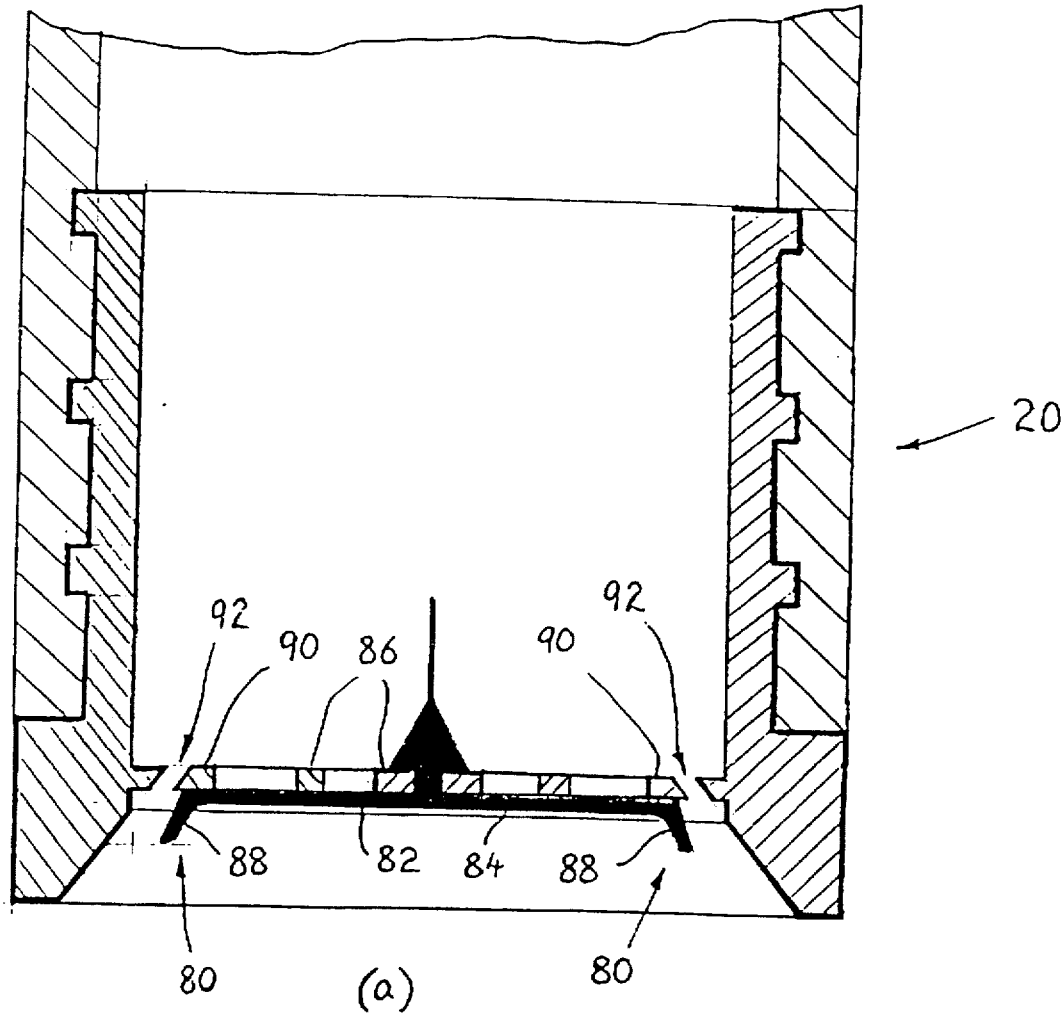
Figure 7:
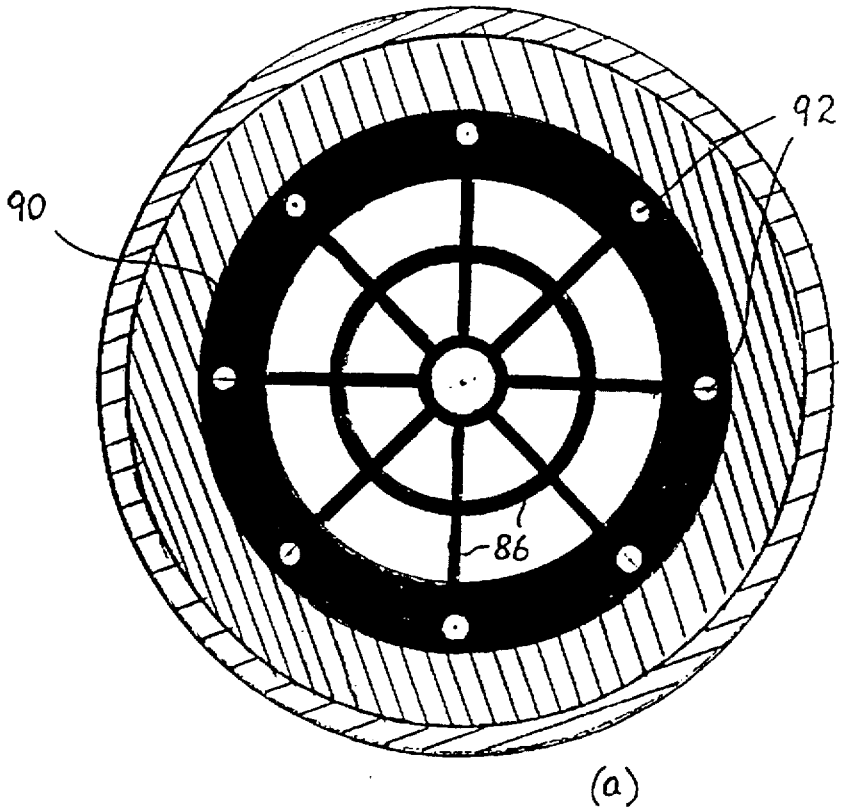
Figure 7:
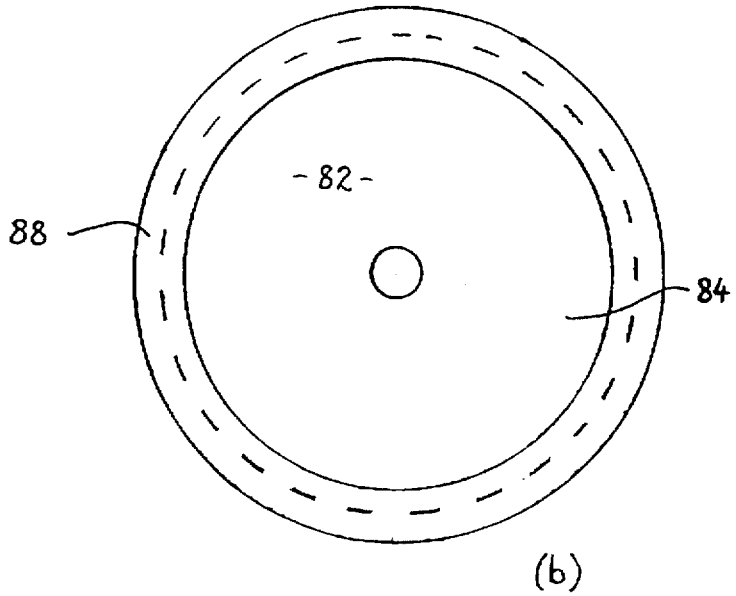

A more preferred form of vacuum control means 80 is illustrated in FIG. 6. In this embodiment, the vacuum control means 80 is provided integral with the flexible diaphragm 82 and operates automatically to prevent any partial vacuum from forming within the flexible hose 18. No additional moving parts are required as in the previous embodiments. Flexible diaphragm 82 is manufactured from a resilient plastics material and is formed with a primary zone 84 that normally lies substantially flat on the support grid 86. The flexible diaphragm also comprises a secondary zone 88 that extends at an angle in a first position above the valve seat 90 as shown in FIG. 6(*a*). Valve seat 90 is formed with a plurality of apertures 92 therein as can be seen most clearly in FIG. 7(*a*). FIG. 7(*b*) is a plan view of the diaphragm 82 showing the configuration of the primary and secondary zones 84, 88.

The secondary zone 88 is movable between the first position in which the diaphragm is not fully sealed against the valve seat 90 and apertures 92 remain open, and a second position in which the diaphragm is fully sealed against the valve seat and apertures 92 are closed as shown in FIG. 6(*b*). The material of the flexible diaphragm 82 is sufficiently resilient in the region of the secondary zone 88 to prevent the diaphragm from fully sealing against the valve seat until the pressure of exhaled air within mouthpiece 16 exceeds a predetermined level. As the diver exhales, the air pressure within the mouthpiece 16 must increase to a level sufficient to cause outlet valve 22 to open against the pressure of ambient water. The back-pressure of air within the mouthpiece 16 will fairly rapidly exceed the predetermined level required to move the secondary zone of diaphragm 82. Once the pressure within mouthpiece 16 exceeds the predetermined level the secondary zone 18 of the diaphragm moves from its first position to its second position so that most of the exhaled air is prevented from returning back into the flexible hose 18. In a conventional inlet valve, the diaphragm closes more or less instantaneously at the end of inhalation. However, in the modified inlet valve of this embodiment, the diaphragm does not fully close until shortly after exhalation commences thereby effectively inhibiting the formation of a partial vacuum within the flexible hose 18.

The secondary zone 88 is still sufficiently flexible to move to the second position to fully seal against the valve seat by water pressure in the event that mouthpiece 16 is flooded with water. When mouthpiece 16 is submerged in water free of the diver's mouth, the mouthpiece will flood but further flooding of the flexible hose 18 is prevented by the inlet valve 20. The diver is able to purge the mouthpiece 16 of water by placing it in his mouth and exhaling orally. Exhaled air forces the water to vent through the outlet valve 22 so that normal function and use of the snorkelling device can be resumed.

With the first and second embodiments 50, 70 of the vacuum control means, the entire snorkelling device can be accidentally flooded with water in certain circumstances. If mouthpiece 16 is held under the water, free of the diver's mouth, and the vacuum control knob 60 or vacuum control tap 76 is left in the open position, water will then be allowed to pass from the mouthpiece 16 into the flexible hose 18. Given time, the entire flexible hose will flood rendering the snorkelling device unusable until such time as the device is purged of water.

If the float 24 and air intake 12 are deliberately inverted and held under water the float valve will be incapable of preventing the ingress of water through apertures 40 into the flexible hose 18. Given time, the entire apparatus will flood. It is perceived that this would need to be a deliberate act, as the natural orientation of the snorkelling device is to hold the float 24 and float valve 14 in a generally upright direction at all times whilst being used on or under the water surface.

The snorkelling device may be readily modified for two person use by bifurcating the flexible hose 18 and providing separate mouthpieces 16 at the end of each branch of the flexible hose 18. The two person snorkelling device would be used in exactly the same way as the one person device, other than the limitations imposed upon each person's freedom of movement by the other. Thus, for example, both persons would need to descend and ascend substantially in unison.

The snorkelling device of the invention may use a conventional air intake with float valve, and a conventional mouthpiece. Therefore, a conversion kit may be supplied to allow the owner of a conventional snorkel to convert her snorkel to the snorkelling device of the invention. The conversion kit would typically comprise a flexible hose adapted to replace the rigid tube of the conventional snorkel connecting the air intake to the mouthpiece. The flexible hose may be provided with an inlet valve proximate the point of connection with the mouthpiece to prevent the return of expelled gases up the flexible hose during exhalation. The kit would further comprise a float to be connected adjacent the air intake and adapted to normally hold the air intake above the surface of the water in the manner described above. Preferably the inlet valve would be provided with some form of vacuum control means as described above.

It will be apparent that the snorkelling device of the invention is not restricted to a diving apparatus solely for recreational use, but may be used by rescuers to supply air to a person or persons trapped in shallow water. The snorkelling device may also be used as an instructional aid for diving skills. Furthermore, the snorkelling device may also be attached to or incorporated in a life vest or jacket as a breathing aid in turbulent water.

From the detailed description of preferred embodiments given above it is apparent that the snorkelling device has a number of advantages over prior art breathing apparatus, including the following:

(i) it allows a person to descend to a depth of up to approximately one meter, and to remain submerged without the use of scuba gear;

(ii) the diver's limit of descent is unrestricted as the entire unit can be drawn under the water with the diver;

(iii) a conventional diver's face mask can be worn with the snorkelling device.

Now that various embodiments of the snorkelling device according to the invention have been described in detail, it will be apparent that numerous variations and modifications may be made, in addition to those already described, without departing from the basic inventive concepts. For example, both the float and weight may be provided integral to the flexible hose of the device, rather than as separate components as in the described embodiments. Furthermore, although the inlet valve of the described embodiments is in the form of a diaphragm valve, any suitable valve may be employed for the inlet and outlet valves for the mouthpiece. All such variations and modifications are to be considered within the scope of the present invention, the nature of which is to be determined from the foregoing description and the appended claims.

I claim:

1. A snorkelling device for supplying air to a person by unassisted lung function to a depth of approximately one meter, the device comprising:

an air intake incorporating a float valve for closing the air intake when it becomes submerged;

a mouth piece connected to the air intake by a flexible hose, the mouth piece having an inlet valve adapted to prevent the return of expelled gases up the flexible hose during exhalation and an outlet valve adapted to allow expelled gases to escape to ambient water during exhalation;

a float provided adjacent the air intake and having sufficient buoyancy to normally hold the air intake above the surface of the water, but wherein the buoyancy is sufficiently low that the float and the air intake incorporating a float valve can be readily submerged when a diver wishes to dive to free diving depths; and, a weight provided in connection with the flexible hose at a prescribed distance from the float such that there is a section of the flexible hose between the weight and the float, the weight being sufficiently heavy to exert a downward force on the flexible hose so as to cause the float and the air intake to maintain a generally upright position whereby, in use, the person can breathe air at atmospheric pressure whilst submerged to depths of up to approximately one meter and can descend without breathing to free diving depths by drawing the float with the air intake down below the surface of the water.

2. A snorkelling device as defined in claim 1, further comprising a vacuum control means for eliminating any partial vacuum that may be formed within the flexible hose in the event the person inhales through the mouthpiece whilst the air intake is fully submerged.

3. A snorkelling device as defined in claim 2, wherein said inlet valve is in the form of a flexible diaphragm mounted on a support grid provided in connection with a valve seat, and wherein said vacuum control means operates by causing the diaphragm to be at least partially lifted from the valve seat thereby providing a path for air to enter the flexible hose.

4. A snorkelling device as defined in claim 3, wherein said flexible diaphragm is manufactured from a resilient plastics material and is formed with a primary zone that normally lies substantially flat on said support grid and a secondary zone that extends at an angle in a first position above said valve seat, said secondary zone comprising said vacuum control means and being movable between said first position in which the diaphragm is not fully sealed against said valve seat, and a second position in which said diaphragm is fully sealed against said valve seat whereby, in use, when the person inhales and then exhales, the diaphragm does not fully seal against the valve seat until the pressure of exhaled air exceeds a predetermined level sufficient to force the secondary zone to move from the first position to the second position.

5. A snorkelling device as defined in claim 3, wherein said vacuum control means comprises a finger-operated slidable member provided adjacent the inlet valve and adapted to lift an edge of the diaphragm from the valve seat when moved from a first position to a second position by the diver.

6. A snorkelling device as defined in claim 2, wherein said vacuum control means comprises a bypass passage provided to bypass said inlet valve and allow a flow of air from the mouthpiece to the flexible hose, said bypass passage having a tap for manually opening and closing the bypass passage.

7. A snorkelling device as defined in claim 1, wherein said mouth piece is one of a pair of mouth pieces whereby, in use, the device can be used to supply air simultaneously to two persons to a depth of approximately one meter.

8. A snorkelling device as defined in claim 1, wherein said float is manufactured of foamed plastics material and has a centre bore in which the air intake is mounted.

9. A conversion kit for converting a conventional snorkel of the type having an air intake incorporating a float valve for closing the air intake when it becomes submerged, the air intake being connected to a mouthpiece by a rigid tube, and the mouthpiece having an outlet valve adapted to allow expelled gases to escape to ambient water during exhalation, to a snorkelling device for supplying air to a person by unassisted lung function to a depth of approximately one meter, the kit comprising:

a flexible hose adapted to replace the rigid tube of the conventional snorkel, the flexible hose having an inlet valve provided proximate the point of connection with the mouthpiece to prevent the return of expelled gases up the flexible hose during exhalation;

a float to be connected adjacent the air intake and having sufficient buoyancy to normally hold the air intake above the surface of the water, but wherein the buoyancy is sufficiently low that the float and the air intake can be readily submerged when a diver wishes to dive to free diving depths; and, a weight adapted to be connected to the flexible hose at a prescribed distance from the float such that there is a section of the flexible hose between the weight and the float, the weight being sufficiently heavy to exert a downward force on the flexible hose so as to cause the float and the air intake to maintain a generally upright position whereby, in use, the person can use the converted snorkel to breathe air at atmospheric pressure whilst submerged to depths of up to approximately one meter and can descend without breathing to free diving depths by pulling the float with the air intake down below the surface of the water.

* * * * *